United States Patent [19]

Boverman et al.

[11] 4,391,170

[45] Jul. 5, 1983

[54] APPARATUS FOR WORKING ON ADVANCING SHEET MATERIAL

[75] Inventors: Bentsion Boverman; Vilen Vodyanitsky, both of West Hartford, Conn.

[73] Assignee: Gerber Garment Technology, Inc., South Windsor, Conn.

[21] Appl. No.: 224,650

[22] Filed: Jan. 12, 1981

[51] Int. Cl.[3] ..... D06H 7/00

[52] U.S. Cl. ..... 83/71; 83/374; 83/734; 83/747; 83/925 CC

[58] Field of Search ..... 83/71, 734, 747, 925 CC, 83/374, 451

[56] References Cited

U.S. PATENT DOCUMENTS 4,328,726 5/1982 Pearl ..... 83/925 CC X

*Primary Examiner*—James M. Meister

*Attorney, Agent, or Firm*—McCormick, Paulding & Huber

[57] ABSTRACT

A machine for cutting an elongated layup of sheet material has a conveyor table for supporting the material and advancing it while it is being cut. A carriage assembly moves a cutting tool in cutting engagement with the material on the conveyor table in response to signals from a programmable controller. The conveyor table and carriage assembly are connected in one system so that the programmed movements of the cutter are relative to the movement of the conveyor thereby enabling the material to be cut in accordance with a predetermined program while simultaneously advanced by the conveyor table. Another cutting machine which has a rotary drum conveyor for supporting and advancing sheet material has a movable tool carriage coupled to the drum conveyor for movement relative to the conveyor by a ring gear and pinion.

19 Claims, 6 Drawing Figures

APPARATUS FOR WORKING ON ADVANCING SHEET MATERIAL

BACKGROUND OF THE INVENTION

This invention relates in general to apparatus for working on sheet material and deals more particularly with improved apparatus of the type which includes a conveyor for advancing material to a work region and supporting the material while it is worked upon by a tool mounted on a movable carriage assembly. The present invention is particularly concerned with improvements in programmable apparatus of the aforedescribed general type for advancing and cutting elongated layups of sheet material. In such programmable apparatus, the conveyor normally operates intermittently to feed or advance successive layups of sheet material or contiguous segments of a long layup to a cutting region. Throughout the feeding mode of the machine cycle, during which material to be cut is advanced by the conveyor, the cutting tool is normally out of cutting engagement with the material. During the cutting mode of the cycle the conveyor and the material thereon remain at rest while a movable carriage assembly moves a cutting tool in cutting engagement with the material. Considerable production time may be lost while the cutting tool is idle and the material is advanced to the cutting region by the conveyor.

It is the general aim of the present invention to provide apparatus of the aforedescribed general type for working on sheet material wherein the material is worked upon by a tool which moves relative to a conveyor and in directions parallel to the direction of conveyor movement while the material is advanced by the conveyor. A further aim of the invention is to provide an improved programmable cutting machine of the aforedescribed type wherein both the cutting tool and the conveyor may move simultaneously and relative to each other so that material may be cut in accordance with a predetermined program while it is being advanced by the conveyor and without alteration of the existing software control for the machine.

SUMMARY OF THE INVENTION

An apparatus for working on sheet material has conveyor means for supporting and moving sheet material, a carriage assembly, means supporting the carriage assembly for movement in one and an opposite direction relative to the conveyor means and parallel to the direction of conveyor means movement, instrument means mounted on the carriage assembly for movement with the carriage assembly and in working engagement with sheet material supported by the conveyor means, and drive means for moving the carriage assembly relative to the conveyor means to move the instrument in working relation to sheet material supported by the conveyor means. In accordance with the invention, the drive means for moving the carriage assembly comprises a pair of coengaging drive elements including one drive element mounted on the conveyor means to move with the conveyor means and another drive element supported on the carriage assembly to move with the carriage assembly and relative to the conveyor means.

DETAILED DESCRIPTION OF PREFERRED EMBODIMENT

Figure 1:
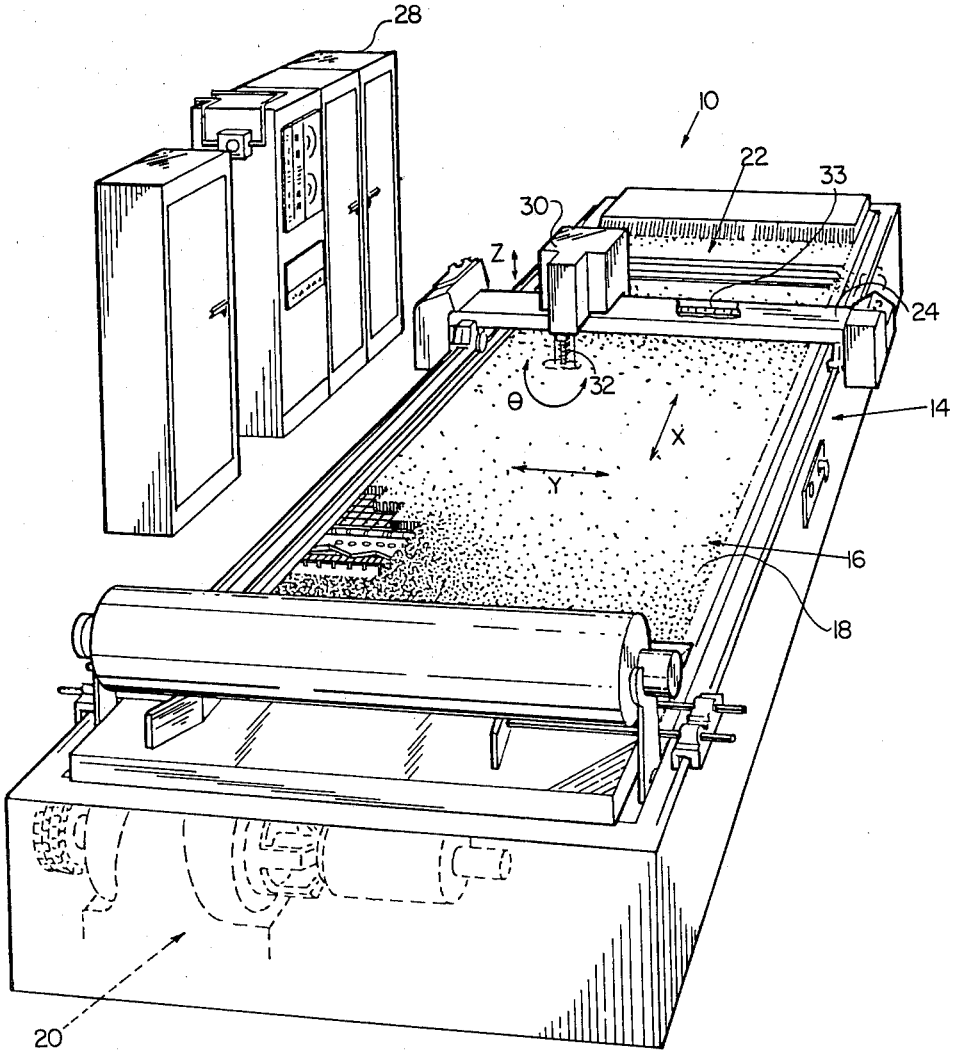
FIG. 1 is a perspective view of a programmable cutting machine embodying the present invention.
Figure 2:
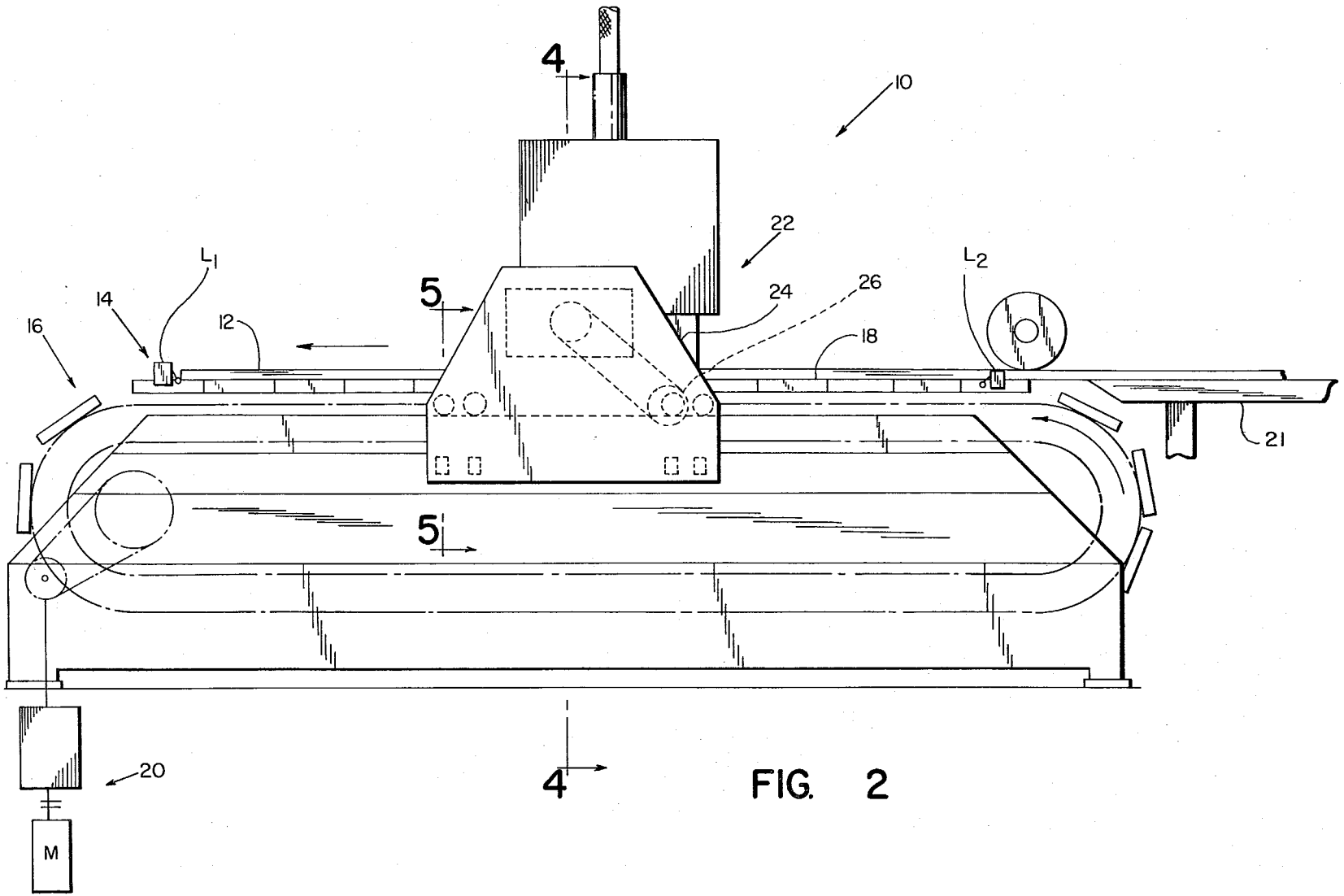
FIG. 2 is a somewhat schematic side elevational view of the machine shown in FIG. 1.
Figure 3:
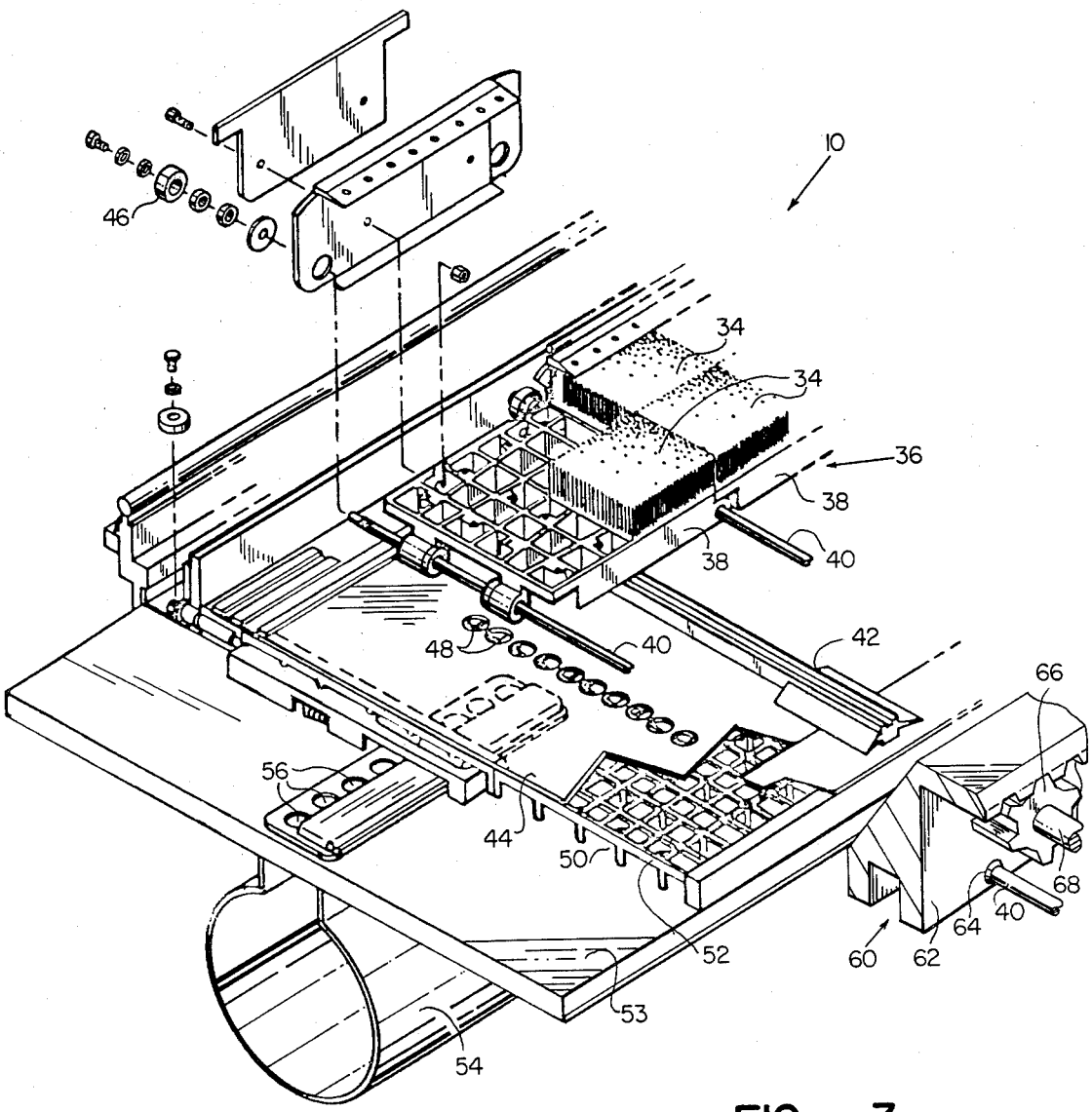
FIG. 3 is a somewhat enlarged exploded fragmentary perspective view showing portions of the conveyor table assembly.

Turning now to the drawings, and referring first particularly to FIGS. 1 and 2, an apparatus for working on sheet material and embodying the present invention is indicated generally by the reference numeral 10. The machine 10 is particularly adapted for advancing and cutting successive layups of sheet material or successive contiguous segments or bites along layup of sheet material, such as indicated at 12 in FIG. 2, and has a conveyor table assembly designated generally by the numeral 14. The table assembly includes a conveyor indicated generally at 16 which defines an upwardly facing material supporting surface 18 and which is driven by a motor and gear reduction unit indicated at 20, and best shown in FIG. 1. The layup 12, which as shown, comprises a plurality of sheets of limp fabric or like material arranged in vertically stacked relation may have a substantially longer length than the material supporting surface, as shown in FIG. 2 wherein the layup is supported, in part, by a layup table designated by the numeral 21.

A tool carriage assembly, indicated generally at 22, which comprises a part of the apparatus 10, has an X-carriage or beam 24 which generally spans the width of the table assembly 14. The beam is supported to move longitudinally of the table assembly 14 in one and an opposite longitudinal (X) coordinate direction and is driven by a motor 26, which receives signals from a programmable controller or computer 28. A Y-carriage 30 mounted on the beam 24 to move with and relative to the beam carries a cutting mechanism which includes a cutting instrument or blade 32. More specifically, the Y-carriage 30 is supported to move in one and an opposite transverse (Y) coordinate direction on the beam 24 and relative to the cutting assembly 14. The drive motor (not shown) mounted on the X-carriage 24 rotates a lead screw 33 in either clockwise or counterclockwise direction in response to signals received from the controller 28 to drive the Y-carriage 30 in one or the other (Y) coordinate directions. Pneumatic cylinders controlled by electrically powered solenoids, but not shown, move the blade 32 in vertical or (Z) coordinate directions in response to signals from the controller 28. The illustrated blade 32 reciprocates with a vertical cutting stroke and is further arranged to rotate in either direction about its vertical axis, as indicated by the coordinate ($\theta$) in FIG. 1, in response to signals from the controller 28. Thus, the blade 32 is supported for compound movement in X, Y and $\theta$ coordinate directions relative to the table assembly 14 in engagement with the layup 12 and for movement in the (Z) coordinate direction into or out of cutting engagement with the layup in response to signals received from the controller 28.

The machine 10 has a working mode during which the reciprocating blade 32 is moved by the carriage assembly 22 in cutting engagement with the layup 12 and the material moving mode during which the layup, or at least a bite of the layup, is advanced by the conveyor 16. While the working or cutting mode and the moving or material advancing mode are referred to as separate modes of operation, it should be understood that these modes may, and preferably do occur simultaneously whereby to effect the most efficient utilization of machine time, as will be hereinafter further evident.

Considering now the machine 10 in further detail and referring more particularly to FIGS. 2–5, the illustrated conveyor table assembly 14 comprises a zoned vacuum holddown conveyor table assembly or System 91 Bite Feed Conveyor System, manufactured and marketed by Gerber Garment Technology, Inc., subsidiary of Gerber Scientific Inc., South Windsor, Conn. The conveyor table assembly 14 may, for example, be approximately 6 feet wide and 36 feet long and comprises the conveyor 16 and a supporting conveyor table structure. The material supporting surface 18 of the conveyor is formed by a plurality of bristle squares or blocks 34, 34 individually plugged into a conveyor grid assembly indicated generally at 36, and best shown in FIG. 3. Each bristle block 34 is preferably molded from plastic material and includes a perforated base and a plurality of bristles integrally connected to and projecting from the base. The perforations in the base of each bristle block 34 communicate with apertures in the grid assembly 36 upon which the bristle block is mounted. The bristle blocks 34, 34 are arranged with the free ends of the bristles disposed in a common plane so that the various bristle blocks which comprise the conveyor 16 cooperate with each other to form a movable perforated bristle mat. The upper run of the bristle mat defines the upwardly facing material supporting surface 18 upon which the layup 12 is spread.

The grid assembly 36 is formed by a plurality of cast aluminum grid plates 38, 38 linked together by transversely extending hinge pins 40, 40. Longitudinally spaced apart and transversely extending seal strips 42, 42 pinned to the base of the grid assembly ride over a stainless steel surface plate 44 which forms the upper surface of the conveyor table. Rollers 46, 46 mounted on the ends of the hinge pins 40, 40 guide the conveyor assembly 16 as it rotates around the end of the conveyor table and while it travels below the table. However, it should be noted that the rollers 46, 46 do not support the upper run of the conveyor assembly, since the seal strips 42, 42 are relied upon for this purpose. A plurality of sets of transversely spaced vacuum holes 48, 48 are formed in the surface plate 44 at longitudinally spaced intervals along the length of the table and provide communication with a vacuum chamber 50 below the surface plate 44. The plate 44 is supported by a stationary grid assembly which includes a plurality of stationary grid sections 52, 52 made of durable plastic and screwed into a pressboard panel 53 which further defines the vacuum chamber 50. A vacuum duct 54 located below the panel 53 communicates with the vacuum chamber 50 through a series of vacuum duct inlets 56, 56. A longitudinally spaced series of control valves 58, 58 (one shown somewhat schematically in FIG. 4) operate to open and close the vacuum duct inlets 56, 56. The valves 58, 58 are actuated by a cam 59 carried by the X-carriage 24 and selectively provide vacuum to successive zones of the material supporting surface 18 as the carriage assembly progresses in one or the opposite X coordinate direction relative to the conveyor table assembly 14, whereby vacuum is applied to a zone of the bristle bed in the immediate vicinity of the cutter 32. A more complete disclosure of a zoned vacuum conveyor table assembly of the aforedescribed general type is found in the U.S. patent application of Pearl, Ser. No. 8,045, now abandoned for APPARATUS AND METHOD FOR WORKING ON SUCCESSIVE SEGMENTS OF SHEET MATERIAL, filed Jan. 31, 1979, and assigned to the assignee of the present invention. The disclosure in the aforesaid patent application is hereby adopted by reference as a part of the present disclosure.

Figure 4:
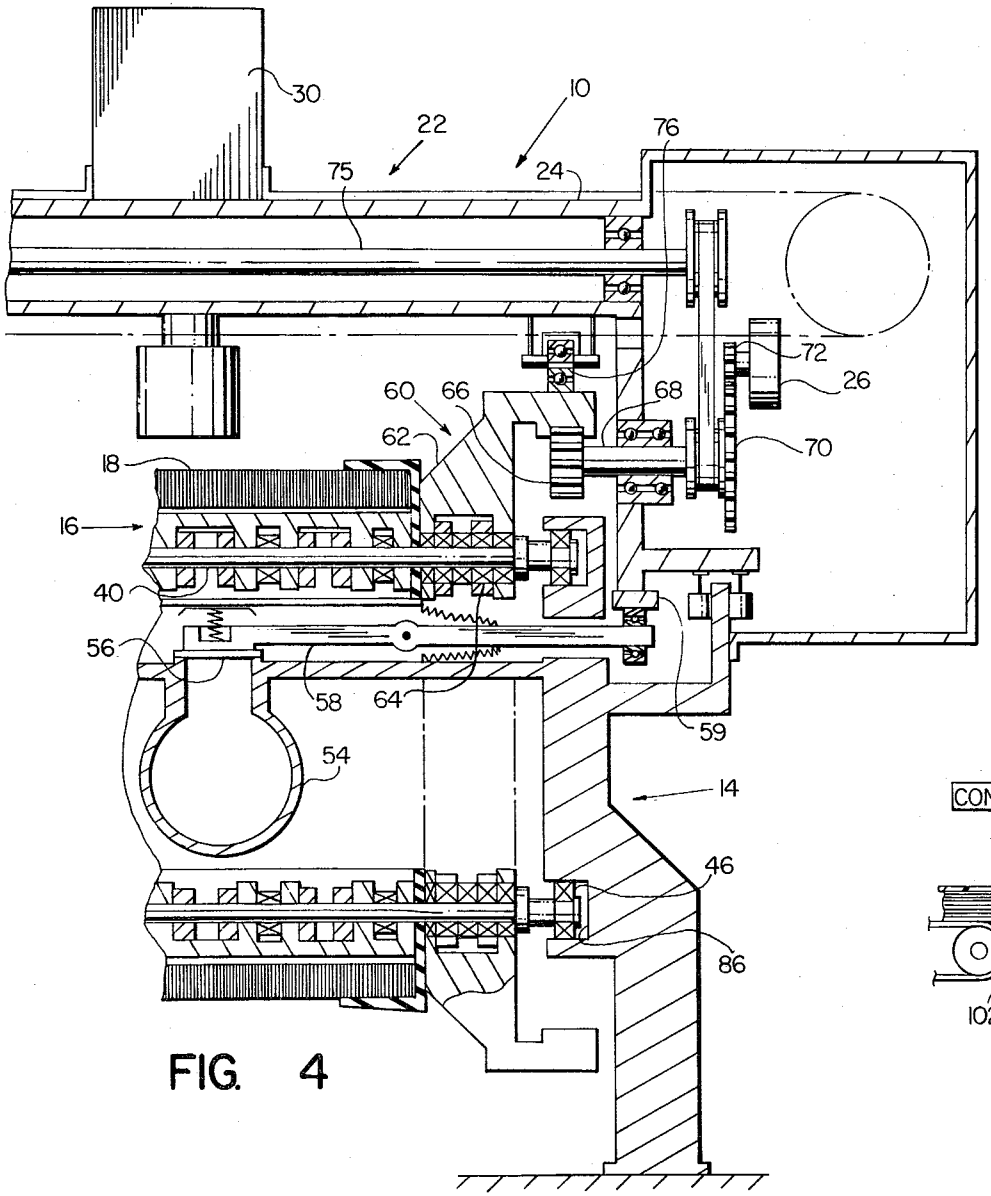
FIG. 4 is a somewhat enlarged fragmentary sectional view taken along the line 4—4 of FIG. 2.

In accordance with the invention the movable carriage assembly 22 and the movable conveyor 16 are interconnected by a common drive system so that the programmed movements of the blade 32 are relative to the movements of the conveyor 16. More specifically, the drive mechanism for moving the carriage assembly 22 relative to the conveyor 16 includes coengaging drive elements, one of the elements being mounted on the conveyor 16 to move with the conveyor and another of the drive elements being supported on the carriage assembly 22 to move with the carriage assembly and relative to the conveyor. In the illustrated machine 10 the one drive element comprises a substantially endless rack assembly indicated generally at 60 and best shown in FIGS. 3–5. The rack assembly 60 is formed by a plurality of individual rack segments 62, 62. Each rack segment 62 is carried by an associated pair of hinge pins 40, 40 and has bushings 64, 64 which receive the hinge pins therethrough as best shown in FIG. 4. The rack segments 62, 62 cooperate to define a downwardly facing rack associated with the upper run of the conveyor 16. The X-carriage or beam 24 carries another drive element or pinion 66 which meshingly engages the rack assembly 60, as best shown in FIG. 4. The pinion 66 is mounted on a shaft 68 journalled on the carriage 24 and is driven through a gear train which includes gears 70 and 72 coupled to the drive motor 26.

Preferably, and as shown, the pinion 66 is drivingly connected to a cross shaft 75 which drives another pinion 66 engaged with another segmented rack assembly at the opposite side of the machine, but not shown. Thus, the beam of X-carriage 24 is driven in proper transverse alignment relative to the conveyor 16 at all times.

Figure 5:
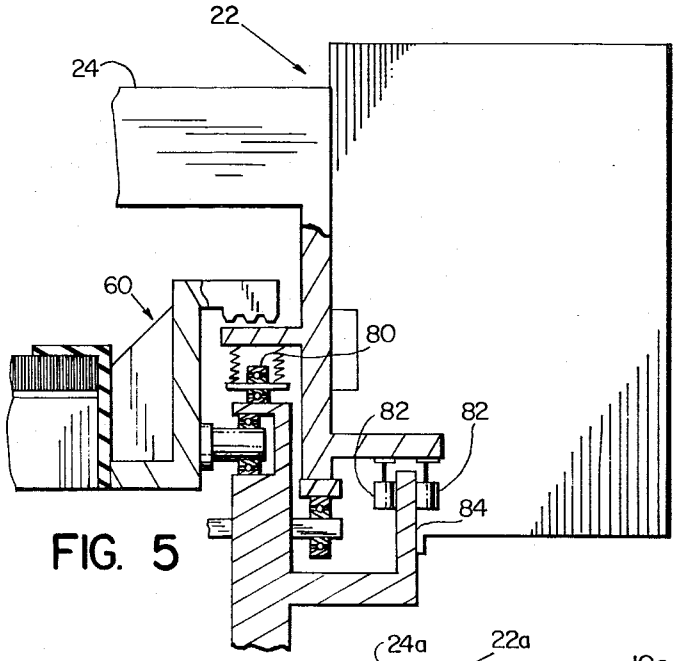
FIG. 5 is a somewhat enlarged fragmentary sectional view taken along the line 5—5 of FIG. 2.

The carriage assembly 22 is preferably supported by bearing rollers 76, 76 which are journalled on the X-carriage 24 and which travel in rolling engagement with the upwardly facing surface of the rack segments 62, 62, as best shown in FIG. 4. Additional support for the carriage assembly 22 may be provided by additional bearing rollers 80, 80 which are journalled on the carriage assembly 22 and which ride upon an upwardly facing surface of the conveyor table frame, as shown in FIG. 5. Additional guide rollers 82, 82 journal for rotation about vertical axes on the carriage assembly 22 engage a longitudinally extending guide member 84 mounted on the conveyor table frame to further retain the carriage assembly for proper tracking relationship with the conveyor assembly 16.

The conveyor 16 moves in the X-coordinate direction to advance a layup of sheet material in response to command signals received by the drive motor 20 from the controller 28 while the carriage assembly 22 moves in the X-coordinate direction in response to signals received by the drive motor 26 from the controller 28. Since the carriage assembly 22 is drivingly connected to the conveyor 16 by coengageable rack segments 62, 62 and pinions 66, 66, movements of the carriage assembly 22 in the X-coordinate directions will at all times be relative to the conveyor 16 whether the conveyor is in motion or at rest. Thus, the machine 10 may be programmed to cut a layup of sheet material 12 while the layup is simultaneously advanced by the conveyor 16.

As previously noted, the upper run of the conveyor 16 is supported on the table by engagement of the sealing members 42 with the surface plate 44. The weight of the lower run of the conveyor is supported by engagement of the rollers 46, 46 within horizontal channels 86, 86 associated with the conveyor table frame, one such channel shown in FIG. 4. The weight of the carriage assembly 22 is borne by the bearing rollers 76, 76 and 80, 80 which respectively engage the upper surface of the rack segments 62, 62 and the upwardly facing surface of the conveyor table frame.

Since the conveyor 16 and the carriage assembly 22 are driven by independent drive motors and move in the X-coordinate direction at different rates relative to each other the relative movements of the conveyor and carriage assembly must be controlled to prevent the cutting blade 32 from traveling beyond either end of the material supporting surface 18 defined by the conveyor 16. This control may be attained by programmed coordination between the cutting patterns generated by the cutting instrument 32 and the conveyor speed or position. However, the illustrated cutting machine 10 has control switches L1 and L2 for this purpose. The switches L1 and L2 are respectively located near opposite ends of the conveyor 16 and operate to vary the speed of travel of the conveyor 16 as the tool carriage assembly 22 and the cutting mechanism carried by it approaches either extremity of the conveyor surface 18. Thus, referring to FIG. 2, assume that the conveyor is advancing a layup 12 in the direction indicated by the directional arrow and the carriage assembly 22 is moving the blade 32 in pattern cutting relation with the moving layup 12. When the carriage assembly 22 approaches the left hand extremity of the conveyor table 14, as viewed in FIG. 2, it engages the limit switch L1 which causes a reduction in the speed of conveyor travel to allow time for the blade 32 to move in pattern cutting engagement with the portion of the layup 12 disposed within the cutting region defined by the conveyor surface 18. Conversely, when in the course of cutting patterns the blade 32 moves toward the opposite or right hand extremity of the cutting table 14, engagement of the carriage assembly with the limit switch L2 causes an increase in the speed of conveyor travel so that the cutting instrument will move in pattern cutting engagement with the portion of the layup within the cutting region.

Figure 6:
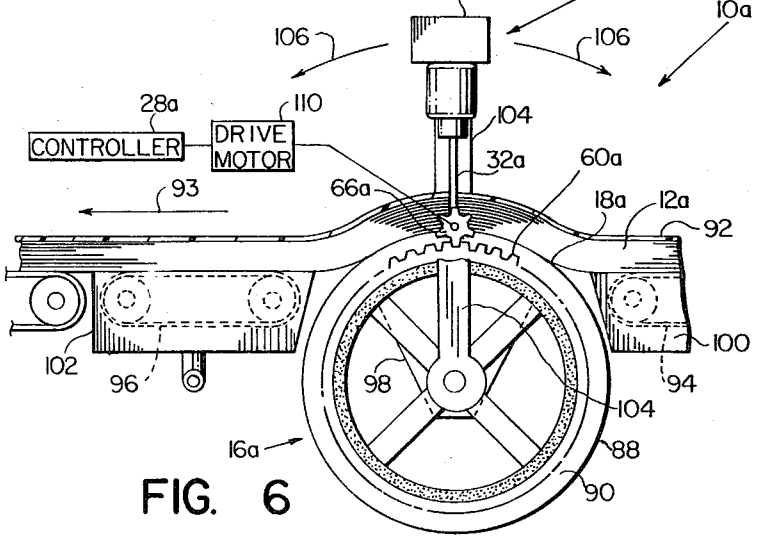
FIG. 6 is a somewhat schematic side elevational view of another machine embodying the present invention.

Referring now to FIG. 6, another sheet material cutting machine embodying the present invention is indicated generally by the reference numeral **10*a*. The machine 10*a* has a conveyor indicated generally at 16*a* which includes a rotary cylindrical drum 88. A bed of supporting material 90 which defines the peripheral surface of the drum is preferably made from foam plastic and has air conducting passageways extending through it from its cylindrical inner surface to its cylindrical outer surface. The drum is supported so that a portion of a layup 12*a* supported, in part, by the drum travels over the drum as the drum is rotated and the layup 12 and an associated air impervious overlay sheet 92 is moved in the X direction as indicated by the directional arrow 93 in FIG. 6. To assist in supporting and moving the layup 12*a* in the X direction, the apparatus may include belt conveyors, such as indicated generally at 94 and 96, located at opposite sides of the drum 88. Vacuum is applied to the lower surfaces of the layup 12*a* in the vicinity of the drum surface by a vacuum chamber defining means or housing 98 located within the drum and having an upwardly facing opening which exposes that portion of the cylindrical drum wall registered therewith to the vacuum therein. Additional vacuum chambers 100 and 102 may be used on either side of the drum 88 for producing vacuum over a great extent of the layup 12*a*. The chambers 100 and 102 preferably provide substantial enclosures for the conveyor belts 94 and 96**, substantially as shown.

A cutter assembly which includes a cutting instrument or blade **32*a* is supported generally above the drum 88 by a carriage assembly 22*a* which includes a bail-like supporting structure 104 arranged for limited pivotal movement about the axis of the drum 88. The support structure 104 supports the blade 32*a* for pivotal movement relative to the drum axis and in X-coordinate directions relative to a portion of the layup 12*a* supported by the drum 88, as indicated by the directional arrows 106, 106. The blade 32*a* is arranged to move in a Y-coordinate direction relative to the carriage assembly 22*a* and is preferably further arranged for rotation about its axis in $\theta$ coordinate directions and for movement in Z-coordinate directions relative to the conveyor 16*a* and a layup 12*a*** supported thereon, as previously discussed.

The drum 88 and the movable carriage assembly **22*a* are interconnected by the common drive system so that programmed movements of the blade 32*a* are relative to the movements of the conveyor system 16*a*. More specifically, the drive mechanism for moving the carriage assembly 22*a* relative to the conveyor 16*a* includes coengageable drive elements, one of the elements being mounted on the conveyor 16*a* to move with it and another of the drive elements being supported upon the carriage assembly 22*a* to move with the carriage assembly and relative to the conveyor 16*a*. In the illustrated machine 10*a* the one drive element comprises at least one ring gear 60*a* mounted in fixed position on the drum 88 for coaxial rotation with the drum. The other drive element comprises a pinion 66*a* carried by the carriage assembly 22*a*. The pinion 66*a* is disposed in meshing engagement with the upwardly facing teeth of the ring gear 60*a* and is driven by a drive motor indicated somewhat schematically at 110 which receives command signals from a controller 28*a***.

The conveyor **16*a* moves in the X-coordinate direction 93 to advance the layup 12*a* in response to command signals received by a drive motor (not shown) from the controller 28*a*. The carriage assembly 22*a* moves in the X-coordinate directions 106, 106 in response to signals received by the drive motor 110 from the controller 28*a*. Thus, movements of the carriage assembly 22*a* in the X-coordinate directions will, at all times, be relative to the conveyor 16*a* whether the conveyor is in motion or at rest. The machine 10*a* may be programmed to cut a layup of sheet material 12*a* while the layup is simultaneously advanced by the conveyor 16*a***.

The invention has been illustrated and described with reference to cutting apparatus which utilize conventional reciprocating blades. However, it should be understood that invention may be practiced with tools of other types capable of doing work on advancing material. Thus, for example, the invention concept is equally applicable to graphical plotting, milling, flame cutting, laser and water jet cutting and other tool forms as well, and such modified forms of apparatus are contemplated within the scope of the present invention.

We claim:

1. In an apparatus for working on sheet material and having conveying means for supporting and moving sheet material, a carriage assembly, means supporting the carriage assembly for movement relative to the conveyor means and in one and an opposite direction generally parallel to the direction of movement of the conveyor means, instrument means mounted on said carriage assembly for movement with the carriage assembly and in working relation to sheet material supported by the conveyor means, and drive means for moving the carriage assembly relative to the conveyor means to move the instrument in working relation to the sheet material supported by the conveyor means, the improvement wherein said drive means comprises coengaging drive elements including one drive element mounted on the conveyor means to move with the conveyor means and another drive element supported on the carriage assembly to move with the carriage assembly and relative to the conveyor means.

2. In an apparatus for working on sheet material as set forth in claim 1 the further improvement wherein one of said drive elements comprises a gear and another of said drive elements comprises a pinion.

3. In an apparatus for working on sheet material as set forth in claim 2 the further improvement wherein said gear is supported on said conveyor means and said pinion is supported on said carriage assembly.

4. In an apparatus for working on sheet material as set forth in either claim 2 or claim 3 the further improvement wherein said conveyor means comprises an endless conveyor and said gear comprises an endless rack.

5. In an apparatus for working on sheet material as set forth in claim 4 the further improvement wherein said endless rack comprises a series of rack segments.

6. In an apparatus for working on sheet material as set forth in claim 5 the further improvement wherein said instrument comprises a cutting instrument.

7. In an apparatus for working on sheet material as set forth in claim 4 the further improvement wherein said conveyor comprises a rotary drum and said gear comprises a ring gear mounted in fixed position relative to said drum for rotation therewith.

8. In an apparatus for working on sheet material as set forth in claim 7 the further improvement wherein said instrument comprises a cutting instrument.

9. In an apparatus for working on sheet material as set forth in any one of claims 1 through 3 the further improvement wherein said conveying means defines a material supporting surface and said apparatus includes control means for maintaining said instrument within the region of said material supporting surface.

10. In an apparatus for working on sheet material as set forth in claim 9 the further improvement wherein said conveyor and said material supporting surface comprises a horizontally disposed and upwardly facing portion of the conveyor surface.

11. In an apparatus for working on sheet material as set forth in claim 9 the further improvement wherein said control means comprises means for varying the relative rate of movement of said conveyor and said instrument.

12. Apparatus for working on sheet material as set forth in claim 11 the further improvement wherein said control means comprises means for varying the speed of said conveyor travel.

13. Apparatus for working on sheet material as set forth in claim 12 wherein said control means comprises means for increasing the speed of travel of said conveyor when said instrument approaches one extremity of said supporting surface and for decreasing the speed of travel of said conveyor when said instrument approaches the opposite end of said supporting surface.

14. In an apparatus for cutting sheet material and having an endless conveyor, a sheet material supporting surface defined by the conveyor, vacuum means for releasably securing sheet material on the supporting surface, a carriage assembly, means supporting the carriage assembly for movement in one and an opposite direction parallel to the direction of movement of the conveyor, a cutter assembly supported on the carriage assembly and including a reciprocating blade, a drive means for moving the carriage assembly in the one and the opposite direction and relative to the material supporting surface to move the blade in cutting engagement with sheet material supported on the supporting surface, the improvement wherein said drive means comprises coengaging drive elements including gear means carried by and movable with said conveyor, a pinion carried by said carriage assembly to move with said carriage assembly and relative to said conveyor and engaged with said gear means, and a drive motor for rotating said pinion in driving engagement relative to said gear means.

15. In an apparatus for cutting sheet material as set forth in claim 14 the further improvement wherein said gear means comprises an endless rack.

16. In an apparatus for cutting sheet material as set forth in claim 15 the further improvement wherein said rack comprises a plurality of rack segments.

17. In an apparatus for cutting sheet material as set forth in claim 14 the further improvement wherein said conveyor comprises a rotary drum and said gear means comprises a ring gear supported in fixed relation to said drum for rotation therewith.

18. In an apparatus for cutting sheet material as set forth in any one of claims 14 through 17 wherein said apparatus includes control means for maintaining said blade within the region of said supporting surface.

19. Apparatus for working on sheet material as set forth in claim 18 wherein said control means comprises means for increasing the speed of travel of said conveyor when said instrument approaches one extremity of said supporting surface and for decreasing the speed of travel of said conveyor when said instrument approaches the opposite end of said supporting surface.

* * * * *